US010215485B2

(12) United States Patent
Chantant et al.

(10) Patent No.: US 10,215,485 B2
(45) Date of Patent: Feb. 26, 2019

(54) METHOD OF TREATING A HYDROCARBON STREAM COMPRISING METHANE, AND AN APPARATUS THEREFOR

(75) Inventors: Francois Chantant, The Hague (NL); Wouter Jan Meiring, Rijswijk (NL)

(73) Assignee: SHELL OIL COMPANY, Houston, TX (US)

( * ) Notice: Subject to any disclaimer, the term of this patent is extended or adjusted under 35 U.S.C. 154(b) by 1462 days.

(21) Appl. No.: 13/807,327

(22) PCT Filed: Jun. 28, 2011

(86) PCT No.: PCT/EP2011/060829
§ 371 (c)(1),
(2), (4) Date: Dec. 28, 2012

(87) PCT Pub. No.: WO2012/001001
PCT Pub. Date: Jan. 5, 2012

(65) Prior Publication Data

US 2013/0098103 A1 Apr. 25, 2013

(30) Foreign Application Priority Data

Jun. 30, 2010 (EP) ..... 10167838

(51) Int. Cl.
*F25J 1/00* (2006.01)
*F25J 1/02* (2006.01)
*F25J 3/02* (2006.01)

(52) U.S. Cl.
CPC ..... *F25J 1/0022* (2013.01); *F25J 1/0052* (2013.01); *F25J 1/0212* (2013.01); *F25J 1/0214* (2013.01);
(Continued)

(58) Field of Classification Search
CPC ..... F25J 1/00221; F25J 1/0052; F25J 1/009; F25J 1/0214; F25J 1/0215; F25J 1/0216;
(Continued)

(56) References Cited

U.S. PATENT DOCUMENTS 3,186,182 A 6/1965 Grossmann et al.
4,002,042 A 1/1977 Pryor et al.
(Continued)

FOREIGN PATENT DOCUMENTS

CN 1745285 3/2006
CN 101108977 1/2008
(Continued)

OTHER PUBLICATIONS

Elliot, D. et al. "Benefits of Integrating NGL Extraction and LNG Liquefaction Technology"; Aiche 2005 Spring National Meeting; 5th Topical Conference on Natural Gas Utilization (TI); Session 16C-Gas; pp. 101-116 and p. 103, paragraph 5-p. 105, Paragraph 5; Jan. 1, 2005.

*Primary Examiner* — Keith Raymond

(57) ABSTRACT

In a method and apparatus for treating a hydrocarbon stream having methane, at least a part of the hydrocarbon stream and a main refrigerant stream are cooled by indirect heat exchanging against a pre-cooling refrigerant. The pre-cooled hydrocarbon stream is passed to a first inlet of an extraction column, and an effluent stream is discharged from the extraction column. The effluent stream and at least a part of the pre-cooled main refrigerant stream are passed to a further heat exchanger, where they are both cooled thereby providing a cooled methane-enriched hydrocarbon stream and at least one cooled main refrigerant stream. The passing of the effluent stream to the further heat exchanger and the passing of the pre-cooled hydrocarbon stream to the first inlet of the extraction column includes indirectly heat
(Continued)

Figure 1:
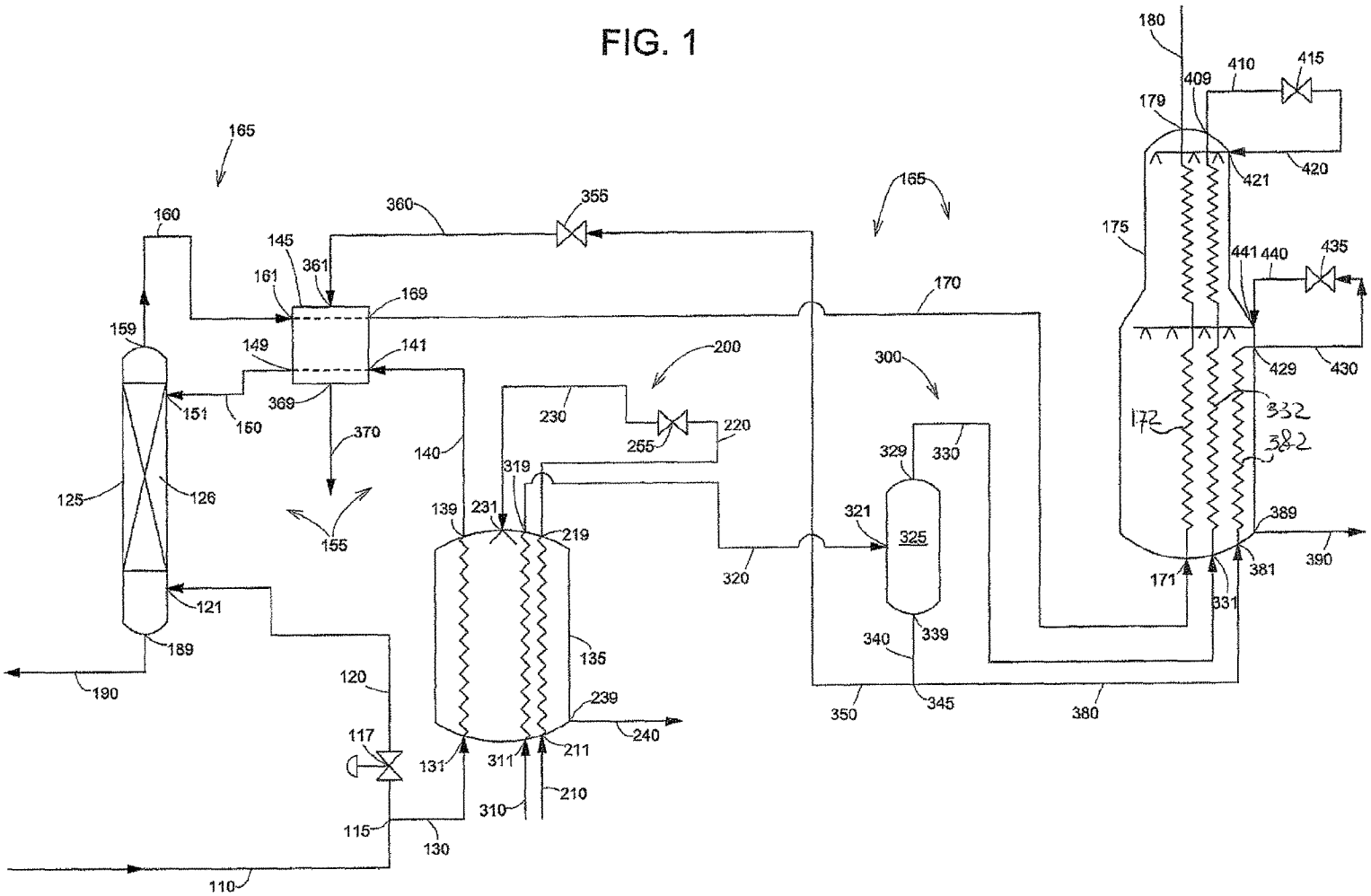

exchanging the effluent stream against the pre-cooled hydrocarbon stream.

8 Claims, 3 Drawing Sheets

(52) U.S. Cl.
CPC ..... *F25J 1/0216* (2013.01); *F25J 1/0238* (2013.01); *F25J 1/0239* (2013.01); *F25J 1/0292* (2013.01); *F25J 3/0209* (2013.01); *F25J 3/0233* (2013.01); *F25J 3/0238* (2013.01); *F25J 2200/02* (2013.01); *F25J 2200/70* (2013.01); *F25J 2210/06* (2013.01); *F25J 2270/18* (2013.01); *F25J 2270/66* (2013.01)

(58) Field of Classification Search
CPC ..... F25J 1/0217; F25J 1/0218; F25J 1/0237; F25J 1/0238; F25J 1/0239; F25J 1/0241; F25J 3/0228; F25J 3/0209; F25J 2210/06; F25J 2270/12; F25J 2270/14; F25J 2270/16; F25J 2270/18; F25J 2270/60; F25J 2270/66
USPC ..... 62/611, 612, 613, 614, 618, 619, 620, 62/621, 623
See application file for complete search history.

(56) References Cited

U.S. PATENT DOCUMENTS

| | | | | |
|---|---|---|---|---|
| 4,171,964 | A | 10/1979 | Campbell et al. | |
| 4,318,723 | A | 3/1982 | Holmes et al. | |
| 4,445,916 | A * | 5/1984 | Newton | 62/625 |
| 4,720,294 | A | 1/1988 | Lucadamo et al. | 62/31 |
| 4,881,960 | A | 11/1989 | Ranke et al. | |
| 5,325,673 | A | 7/1994 | Durr et al. | |
| 5,537,827 | A | 7/1996 | Low et al. | |
| 5,615,561 | A | 4/1997 | Houshmand et al. | |
| 5,685,170 | A | 11/1997 | Sorensen | |
| 5,832,745 | A | 11/1998 | Klein Nagelvoort et al. | 62/619 |
| 6,119,479 | A * | 9/2000 | Roberts et al. | 62/612 |
| 6,354,105 | B1 * | 3/2002 | Lee | F25J 3/0209 62/619 |
| 6,370,910 | B1 | 4/2002 | Grootjans et al. | 62/613 |
| 6,609,393 | B2 | 8/2003 | Oakey | |
| 2002/0029585 | A1 | 3/2002 | Stone et al. | |
| 2004/0065113 | A1 * | 4/2004 | Paradowski | 62/613 |
| 2004/0079107 | A1 | 4/2004 | Wilkinson et al. | 62/611 |
| 2004/0261452 | A1 | 12/2004 | Mak et al. | |
| 2007/0240450 | A1 | 10/2007 | Mak | |
| 2007/0245771 | A1 * | 10/2007 | Spilsbury | 62/620 |
| 2008/0016910 | A1 * | 1/2008 | Brostow et al. | 62/630 |
| 2008/0115532 | A1 | 5/2008 | Jager | |
| 2008/0156036 | A1 * | 7/2008 | Buijs et al. | 62/612 |
| 2009/0064712 | A1 | 3/2009 | Buijs et al. | 62/613 |
| 2009/0064713 | A1 | 3/2009 | Buijs et al. | 62/613 |
| 2010/0037654 | A1 * | 2/2010 | Kevenaar et al. | 62/614 |

FOREIGN PATENT DOCUMENTS

| | | | | |
|---|---|---|---|---|
| CN | 101287691 | | 10/2008 | |
| CN | 101460800 | | 6/2009 | |
| CN | 101711335 | | 5/2010 | |
| DE | 10226596 | | 1/2004 | |
| DE | 102007007097 | | 8/2008 | |
| DE | 102007045303 | | 4/2009 | |
| EP | 612968 | | 4/1997 | |
| EP | 1367350 | A1 * | 12/2003 | |
| EP | 1881283 | | 1/2008 | F25J 1/020 |
| ES | 2101367 | | 7/1997 | |
| FR | 2102930 | | 7/1972 | |
| GB | 1572900 | | 8/1980 | |
| GB | 2102930 | | 2/1983 | |
| SU | 366323 | | 7/1971 | |
| WO | 2006061400 | | 6/2006 | |
| WO | WO2006061400 | | 6/2006 | C10G 5/06 |
| WO | 20090076357 | | 6/2009 | |

* cited by examiner

METHOD OF TREATING A HYDROCARBON STREAM COMPRISING METHANE, AND AN APPARATUS THEREFOR

PRIORITY CLAIM

The present application claims priority from PCT/EP2011/060829, filed 28 Jun. 2011, which claims priority from European patent 10167838.1, filed 30 Jun. 2010, which is incorporated herein by reference.

The present invention relates to a method and apparatus for treating a hydrocarbon stream comprising methane.

Hydrocarbon streams comprising methane can be derived from a number of sources, such as natural gas or petroleum reservoirs, or from a synthetic source such as a Fischer-Tropsch process. In the present invention, the hydrocarbon stream preferably comprises, or essentially consists of, natural gas. It is useful to treat and cool such streams for a number of reasons. It is particularly useful to liquefy the hydrocarbon stream.

Natural gas is a useful fuel source, as well as a source of various hydrocarbon compounds. It is often desirable to liquefy natural gas in a liquefied natural gas (LNG) plant at or near the source of a natural gas stream for a number of reasons. As an example, natural gas can be stored and transported over long distances more readily as a liquid than in gaseous form because it occupies a smaller volume and does not need to be stored at high pressure.

U.S. Pat. No. 6,370,910 discloses a method and apparatus for liquefying a stream enriched in methane. A natural gas stream is pre-cooled and supplied to an extraction column, where heavier hydrocarbons are removed from the natural gas. A gaseous overhead stream is withdrawn from the top of the extraction column, and passed to a third tube side arranged in an auxiliary heat exchanger. A main multicomponent refrigerant stream is also passed to the auxiliary heat exchanger, but to a first tube side arranged therein. Finally, an auxiliary multicomponent refrigerant stream is also passed to the auxiliary heat exchanger, but to a second tube. All three streams are cooled in the auxiliary heat exchanger against the cooled auxiliary multicomponent refrigerant which has been passed to the shell side of the auxiliary heat exchanger via an expansion device.

A drawback of the method and apparatus of U.S. Pat. No. 6,370,910 is that there may be quite a high temperature difference between the main multicomponent refrigerant stream and the gaseous overhead stream withdrawn from the top of the extraction column, as they enter the auxiliary heat exchanger. This, in turn, may cause thermal stresses (in particular in coil-wound heat exchangers) and internal pinching in the auxiliary heat exchanger, which may lead to unstable behaviour in the cooling process and damage to the heat exchanger.

In US patent application publication No. 2008/016910 an integrated NGL recovery in the production of liquefied natural gas is described. Components heavier than methane are recovered in a distillation column wherein cooled natural gas is separated into an overhead vapour enriched in methane and a bottoms stream enriched in the heavier components. The distillation column utilizes a liquefied methane-containing reflux stream, provided by a condensed portion of the overhead vapour from the distillation column or a portion of totally condensed overhead vapour that is subsequently warmed. The cooled feed stream to the distillation column may be further cooled against the overhead vapour in an optional economizer heat exchanger.

The present invention provides a method of treating a hydrocarbon stream comprising methane, the method comprising:

- cooling at least a part of the hydrocarbon stream and a main refrigerant stream by indirect heat exchanging against a pre-cooling refrigerant, to provide a pre-cooled hydrocarbon stream and a pre-cooled main refrigerant stream;
- passing the pre-cooled hydrocarbon stream to a first inlet of an extraction column;
- discharging an effluent stream, in the form of a methane-enriched hydrocarbon stream, from the extraction column via a vapour outlet arranged gravitationally higher relative to the first inlet into the extraction column, and a liquid methane-depleted hydrocarbon stream from the extraction column via a liquid outlet arranged gravitationally lower relative to the first inlet into the extraction column;
- passing the effluent stream to a further heat exchanger;
- passing at least a part of the pre-cooled main refrigerant stream to the further heat exchanger; and
- cooling both the effluent stream and the at least part of the pre-cooled main refrigerant stream in the further heat exchanger thereby providing a cooled methane-enriched hydrocarbon stream and at least one cooled main refrigerant stream;

wherein said passing of the effluent stream to the further heat exchanger and said passing of the pre-cooled hydrocarbon stream to the first inlet of the extraction column comprises indirectly heat exchanging the effluent stream against the pre-cooled hydrocarbon stream.

In another aspect, the present invention provides an apparatus for treating a hydrocarbon stream comprising methane, the apparatus comprising:

- at least one pre-cooling heat exchanger arranged to cool at least a part of the hydrocarbon stream and a main refrigerant stream by indirect heat exchanging against a pre-cooling refrigerant, to provide a pre-cooled hydrocarbon stream at a first outlet of the pre-cooling heat exchanger and a pre-cooled main refrigerant stream at a third outlet;
- an extraction column provided with a first inlet, a vapour outlet arranged gravitationally higher relative to the first inlet into the extraction column and a liquid outlet arranged gravitationally lower relative to the first inlet into the extraction column;
- first connecting means fluidly connecting the first inlet of the extraction column to the first outlet of the pre-cooling heat exchanger;
- a further heat exchanger provided with a first inlet for receiving the effluent from the vapour outlet of the extraction column and at least one second inlet for receiving at least a continuing part of the pre-cooled main refrigerant stream from said third outlet, the further heat exchanger also provided with a first outlet for discharging a cooled methane-enriched hydrocarbon stream and at least one second outlet for discharging at least one cooled main refrigerant stream;
- second connecting means fluidly connecting the vapour outlet of the extraction column with the first inlet of the further heat exchanger;
- refrigerant circulation means arranged to supply a cooling refrigerant to the further heat exchanger and to withdraw the cooling refrigerant from the further heat exchanger downstream of a cooling zone in the further heat exchanger;

first tube means passing through the cooling zone in the further heat exchanger and fluidly connecting the first inlet with the first outlet and at least second tube means passing through the cooling zone in the further heat exchanger and fluidly connecting the at least one second inlet with the at least one second outlet; and an extraction column heat exchanger provided in the first connecting means and the second connecting means and arranged for indirect heat exchanging between the pre-cooled hydrocarbon stream and the effluent from the vapour outlet of the extraction column.

Figure 2:
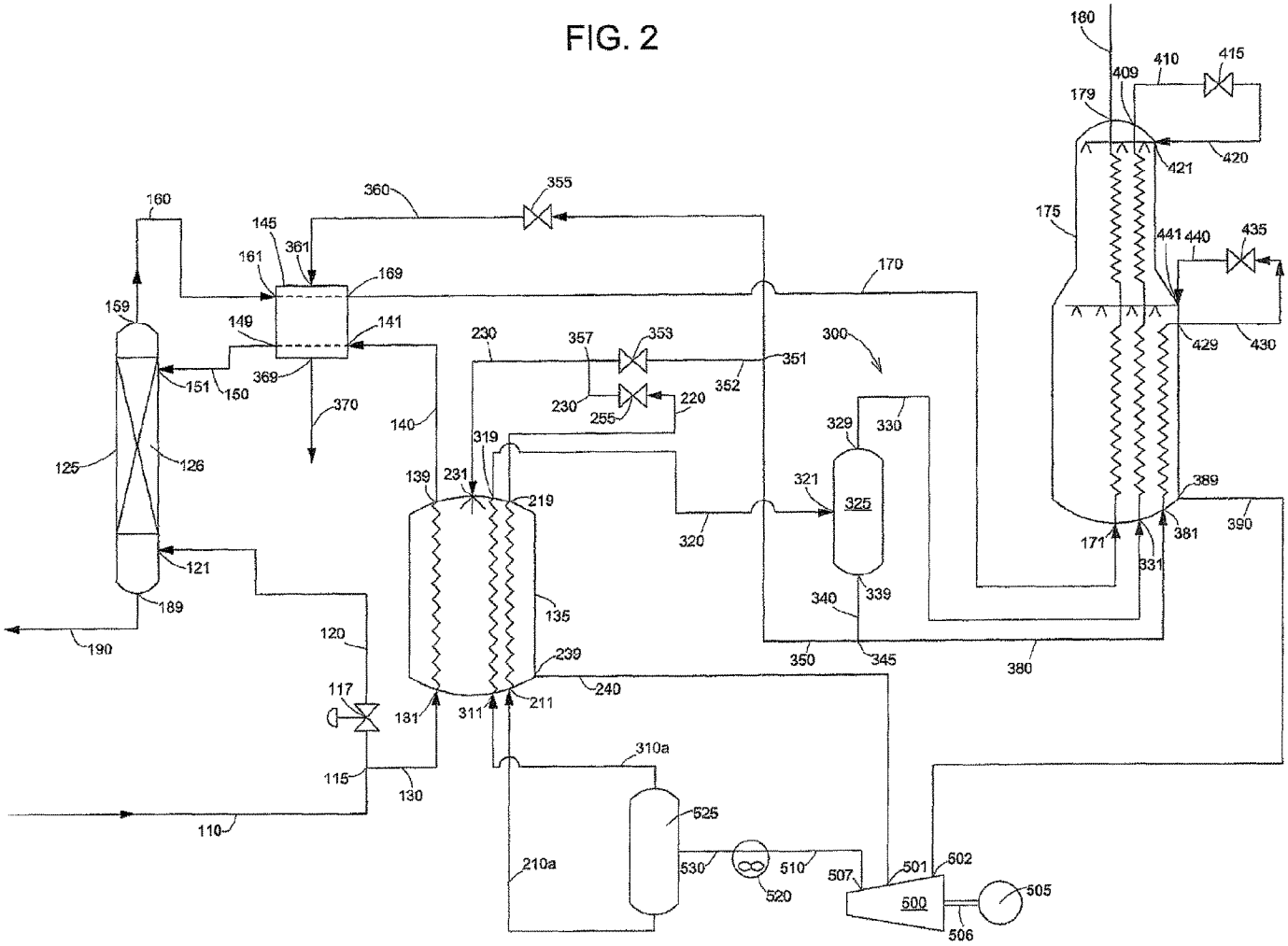
Figure 3:
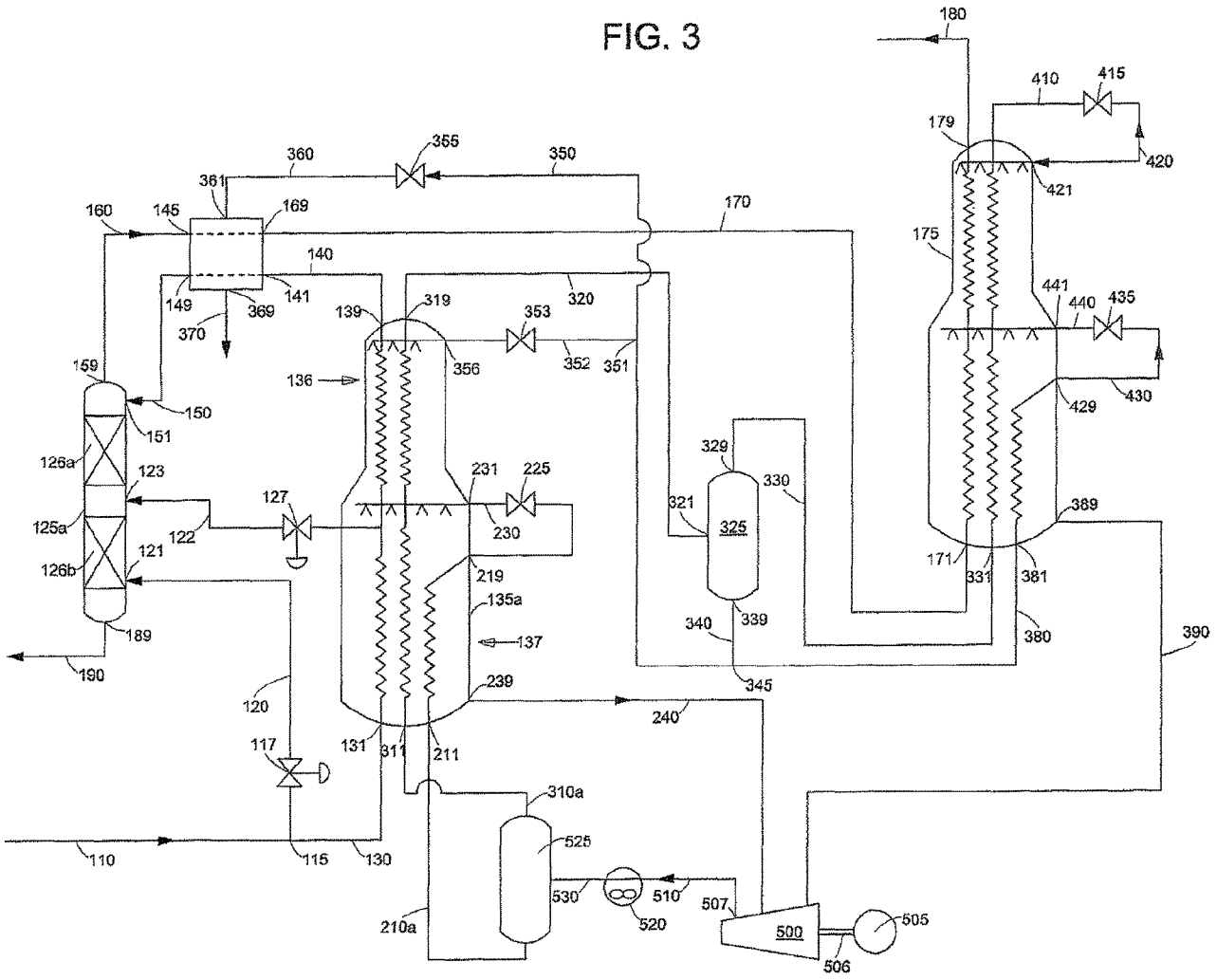

The invention will be further illustrated hereinafter, using examples and with reference to the drawing in which;

FIG. 1 schematically represents a process flow scheme representing a method and apparatus according to an embodiment of the invention;

FIG. 2 schematically represents a process flow scheme representing a method and apparatus according to another embodiment of the invention;

FIG. 3 schematically represents a process flow scheme representing a method and apparatus according to still another embodiment of the invention.

In these figures, same reference numbers will be used to refer to same or similar parts. Furthermore, a single reference number will be used to identify a conduit or line as well as the stream conveyed by that line.

In the context of the present application, "methane-enriched" refers to having a higher relative methane content than the hydrocarbon stream being treated. Likewise, "methane-depleted" refers to having a lower relative methane content than the hydrocarbon stream being treated.

The present disclosure involves producing of a cooled methane-enriched hydrocarbon stream, comprising pre-cooling, extraction of heavies, and subsequent cooling in a further heat exchanger. It is presently proposed to pre-cool at least a part of the hydrocarbon stream and a main refrigerant stream to provide a pre-cooled hydrocarbon stream and a pre-cooled main refrigerant stream, and to indirectly exchange heat between the methane-enriched vapour effluent from the extraction column and the pre-cooled hydrocarbon stream prior to its admission into the extraction column. Herewith it is achieved that the temperature of the methane-enriched vapour effluent is restored, within the limits of the approach temperature of the extraction column heat exchanger, to better match the temperature of the pre-cooled hydrocarbon stream.

This way, the temperature difference between the methane-enriched vapour effluent and the pre-cooled main refrigerant stream is substantially the same, such as the same within the approach temperature of the extraction column heat exchanger—for instance within 10° C.—as the temperature difference between the original pre-cooled hydrocarbon stream and the pre-cooled main refrigerant stream, regardless of the temperature conditions in the extraction column.

As a result, any pinching and thermal stress that may be induced in a further heat exchanger when the methane-enriched effluent and the pre-cooled main refrigerant streams are fed into such further heat exchanger would not be significantly worse than would be the case if the pre-cooled hydrocarbon stream would be passed to the further heat exchanger without having passed through the extraction column.

Preferably, the pre-cooled hydrocarbon stream and the pre-cooled main refrigerant stream, as they are discharged from the pre-cooling heat exchanger(s), may have substantially the same pre-cool temperature, for instance within 10° C. from each other, preferably within 5° C. from each other. This can for instance be achieved by pre-cooling the part hydrocarbon stream and the main refrigerant stream separately from each other in separate heat exchangers, by heat exchanging against one or more pre-cooling refrigerants evaporating at the same temperature level. But preferably, the part of the hydrocarbon stream and the main refrigerant stream are pre-cooled in at least one common heat exchanger, such as a tube in shell heat exchanger wherein the part of the hydrocarbon stream and the main refrigerant stream pass in mutually separate pre-cooling tube bundles through a common shell.

The pre-cool temperature of the pre-cooled hydrocarbon stream may for instance be in the range of from −20° C. to −80° C.

In preferred embodiments, the effluent stream before it is subjected to said indirectly heat exchanging against the pre-cooled hydrocarbon stream has a temperature lower than the temperature of the pre-cooled hydrocarbon stream. This may not always be the case, for example when heat is added to the extraction column. If this is not the case and/or to assist achieving this, heat may be extracted from at least one of:

the pre-cooled hydrocarbon stream not being upstream of the indirect heat exchanging with the methane-enriched vapour effluent from the extraction column;

the methane-enriched vapour effluent from the extraction column before having completed its indirect heat exchanging with the pre-cooled hydrocarbon stream;

vapour and/or liquid within the extraction column in an area at or between the first inlet into the extraction column and the vapour outlet from the extraction column, by heat exchanging, suitably by indirect heat exchanging, against an auxiliary refrigerant stream in addition to the indirect heat exchanging between the methane-enriched vapour effluent from the extraction column and the pre-cooled hydrocarbon stream. The result is that pre-cooled hydrocarbon stream is further cooled down, and/or its temperature lowered. In case heat is added to the extraction column, at least a part of the added heat is removed via the auxiliary refrigerant, suitably simultaneously during the adding of the heat.

Preferably, the auxiliary refrigerant contains a liquid fraction, which evaporates at least in part by said heat exchanging. The evaporated part may, for instance as a part of a spent auxiliary refrigerant stream, be compressed for reuse in a suitable refrigerant compressor such as a main refrigerant compressor of a refrigerant circuit.

The hydrocarbon stream contains methane. The hydrocarbon stream may be obtained from natural gas or petroleum reservoirs or coal beds. As an alternative the hydrocarbon stream may also be obtained from another source, including as an example a synthetic source such as a Fischer-Tropsch process. Preferably the hydrocarbon stream comprises at least 50 mol % methane, more preferably at least 80 mol % methane.

Depending on the source, the hydrocarbon stream may contain varying amounts of other components, including one or more non-hydrocarbon components such as $H_2O$, $N_2$, $CO_2$, Hg, $H_2S$ and other sulphur compounds; and one or more hydrocarbons heavier than methane such as in particular ethane, propane and butanes, and, possibly lesser amounts of pentanes and aromatic hydrocarbons. Hydrocarbons having the molecular mass of at least that of an n-th alkane, which is an alkane based on n carbon atoms, will be referred to as $C_n$+. For example, $C_5$+ means hydrocarbons having the molecular mass of at least that of pentane.

Hydrocarbons with a molecular mass of at least that of propane may herein be referred to as $C_3$+ hydrocarbons, and hydrocarbons with a molecular mass of at least that of ethane may herein be referred to as $C_2$+ hydrocarbons.

If desired, the hydrocarbon stream may have been pre-treated to reduce and/or remove one or more of undesired components such as $CO_2$ and $H_2S$, or have undergone other steps such as early cooling, pre-pressurizing or the like. As these steps are well known to the person skilled in the art, their mechanisms are not further discussed here.

The composition of the hydrocarbon stream thus varies depending upon the type and location of the gas and the applied pre-treatment(s).

FIG. 1 schematically shows a process flow scheme that can be embodied in a method and apparatus for treating a hydrocarbon stream 110, to provide a cooled methane-enriched hydrocarbon stream 180. The apparatus comprises extraction column 125 provided with a first inlet 151, a vapour outlet 159 and a liquid outlet 189. The vapour outlet 159 is arranged gravitationally higher than the first inlet 151, the liquid outlet 189 gravitationally lower than the first inlet 151. The first inlet may comprise an inlet distributor (not shown) internal to the extraction column 125, as known in the art.

The hydrocarbon stream 110 may comprise, optionally essentially consist of, natural gas and it may have been pre-treated. The hydrocarbon stream 110 is provided at a feed temperature and a feed pressure.

For typical hydrocarbon feed gas compositions, the feed pressure may be anywhere between 10 and 120 bar absolute (bara), but more typically between 25 and 80 bara. The feed temperature may typically be at or close to ambient temperature, whereby the ambient temperature is the temperature of the air outside the feed line 110. For instance, the feed temperature may typically be within 10° C. from the ambient temperature. The ambient temperature usually fluctuates depending on the time of the day, and on the season, but it may be typically anywhere between −10° C. and +50° C.

The extraction column 125 may be provided in the form of any type of cryogenic distillation column suitable for extraction of propane and butanes and optionally ethane from the hydrocarbon stream. The extraction column 125 may suitably be in the form of a so-called scrub column, which may operate at a relatively high pressure compared to some other types of extraction columns. Typically, the extraction column is provided with a liquid-vapour contacting zone 126 in the form of trays and/or packing. Optionally, as shown in FIG. 1, the extraction column 125 may have other inlets, such as the second inlet 121.

The preferred pressure of operation in the extraction column 125 depends on the composition of the hydrocarbon feed stream 110 and the target specification of vapour discharged at the vapour outlet 159. However, it is generally below the critical point pressure, the critical point pressure being the pressure at the cricondenbar of the phase diagram belonging to the specific composition of the hydrocarbon feed stream. Natural gas liquids may be extracted in an extraction column at pressures of down to 50 bar below the critical point temperature. However, if the ultimate goal is to produce a liquefied hydrocarbon stream, the preferred pressure is between 2 and 15 bar below the critical point pressure, more preferred between 2 and 10 bar below the critical point pressure, which allows for less (re-)compression. These pressure ranges may be achieved in a scrub column. If the pressure is higher than that range, the operation of the extraction column 125 will become too ineffective, while if the pressure is lower than that range then the energy efficiency of subsequent liquefaction of the methane-enriched hydrocarbon stream will become lower.

A pre-cooling heat exchanger 135 is provided to cool at least a part 130 of the hydrocarbon stream 110 and a main refrigerant stream 310, by indirect heat exchanging against a pre-cooling refrigerant 230. The pre-cooling refrigerant may be circulated in a pre-cooling refrigerant circuit 200 (partly shown). The pre-cooling heat exchanger 135 discharges at least a pre-cooled hydrocarbon stream 140 and a pre-cooled main refrigerant stream 320.

The pre-cooling heat exchanger 135 as shown in FIG. 1 comprises a first pre-cooling tube bundle connecting a first inlet 131 with a first outlet 139 through a pre-cooling cooling zone in the pre-cooling heat exchanger 135; a second pre-cooling tube bundle connecting a third inlet 311 with a third outlet 319 through the pre-cooling cooling zone; and third pre-cooling tube bundle connecting a second inlet 211 with a second outlet 219 through the pre-cooling cooling zone. Additionally, the pre-cooling heat exchanger 135 is provided with a shell inlet 231 to provide access to the pre-cooling cooling zone and a shell outlet 239 to discharge spent pre-cooling refrigerant from the pre-cooling cooling zone.

The pre-cooling refrigerant may be a single-component refrigerant such as propane, or a multicomponent refrigerant. For example, the multicomponent refrigerant may contain a mixture of hydrocarbon components including one or more of pentanes, butanes, propane, propylene, ethane, and ethylene.

The pre-cooling refrigerant circuit 200 may comprise a pre-cooling refrigerant compressor (not shown), optionally preceded by a suction drum (not shown), but followed by one or more coolers (not shown) wherein the compressed pre-cooling refrigerant may be cooled against ambient, and an optional accumulator (not shown). This equipment provides a compressed ambient cooled pre-cooling refrigerant stream in line 210, which is connected to the second inlet 211 in the pre-cooling heat exchanger. The second outlet 219 is connected to the shell inlet 231 via lines 220 and 230 which are connected to each other via an expansion device that is here shown in the form of a Joule-Thomson valve 225. The shell outlet 239 discharges into line 240 which serves to convey spent refrigerant back to the pre-cooling refrigerant compressor (optionally via a suction drum) where it can be recompressed to provide the compressed ambient cooled pre-cooling refrigerant stream in line 210.

The first outlet 139 from the pre-cooling heat exchanger discharges the pre-cooled hydrocarbon stream into line 140. The third outlet 319 from the pre-cooling heat exchanger 135 discharges pre-cooled main refrigerant stream into line 320.

The first outlet 139 of the pre-cooling heat exchanger 135 is fluidly connected to the first inlet 151 of the extraction column 125 via first connecting means 155. In the embodiment shown in FIG. 1 in more detail, the first outlet 139 from the pre-cooling heat exchanger 135 discharges into a line 140, which in turn is connected to a line 150 via an extraction column heat exchanger 145. Thus line 140 is connected to a first inlet 141 of the extraction column heat exchanger 145, which is internally connected to a first outlet 149 that discharges into line 150. Line 150 is connected to the first inlet 151 of the extraction column 125 and discharges into the extraction column 125. The extraction column heat exchanger 145 may be provided in the form of a tube-in-shell type heat exchanger or pipe-in-pipe heat exchanger, but preferred is a plate-type heat exchanger such as a plate-fin heat exchanger and/or a printed circuit heat exchanger, optionally in a cold box.

There is preferably essentially no separate heat exchanger present between the pre-cooling heat exchanger 135 and the extraction column heat exchanger 145. Thus, no heat exchanging with another medium will be taking place other than de-minimis unavoidable heat exchanging with the environment via the piping used for line 140 downstream of pre-cooling heat exchanger 135 and upstream of the extraction column heat exchanger 145. The temperature of the pre-cooled hydrocarbon stream 140 as it passes into the extraction column heat exchanger 145 is therefore essentially equal to the temperature at which the pre-cooled hydrocarbon stream 140 is discharged from the pre-cooling heat exchanger 135. In practice this may mean that the temperature of the pre-cooled hydrocarbon stream 140 as it passes into the extraction column heat exchanger 145 is less than 5° C. different, preferably less than 2° C. different, from the temperature at which the pre-cooled hydrocarbon stream 140 is discharged from the pre-cooling heat exchanger 135.

The liquid outlet 189 from the extraction column 125, preferably located at or near the bottom of the extraction column 125 and/or below the contact zone 126, discharges into line 190, which may convey the liquid effluent from the extraction column 125 to further treatment, typically involving stabilization and/or fractionation. The vapour outlet 159 from the extraction column 125, preferably located at or near the top of the extraction column 125 and/or overhead of the contact zone 126, discharges into line 160. The effluent from this vapour outlet 159 eventually is conveyed to a first inlet 171 of a further heat exchanger 175.

In the embodiment of FIG. 1, the further heat exchanger 175 is provided in the form of a coil-wound heat exchanger. The further heat exchanger 175 is provided to further cool both the effluent 160 from the extraction column 125 and at least part of the pre-cooled main refrigerant stream 320 from the pre-cooling heat exchanger 135, to thereby provide a cooled methane-enriched hydrocarbon stream 180 and at least one cooled main refrigerant stream 410,430. This is accomplished by indirect heat exchanging against a cooling refrigerant (420,440) that is circulated in a refrigerant circuit 300 (partly shown). The cooled methane-enriched hydrocarbon stream 180 is discharged from a first outlet 179 in the further heat exchanger 175 and, in the embodiment drawn in FIG. 1, a first part cooled main refrigerant stream 410 is discharged from a first second outlet 409 from the further heat exchanger 175 while a second part cooled main refrigerant stream 430 is discharged from a second second outlet 429 from the further heat exchanger 175.

The further heat exchanger 175 as shown in FIG. 1 comprises first tube means in the form of a first cooling tube bundle 172 connecting a first inlet 171 with the first outlet 179 through a cooling zone in the further heat exchanger 175; and second tube means in the form of a first second cooling tube bundle 332 connecting a first third inlet 331 with the first second outlet 409 through the cooling zone and a second cooling tube bundle 382 connecting a second inlet 381 with the second second outlet 429 through the cooling zone.

Second connecting means 165 fluidly connects the vapour outlet 159 of the extraction column 125 with the first inlet 171 of the further heat exchanger 175. In the embodiment shown in FIG. 1 in more detail, the vapour outlet 159 from the extraction column 125 discharges into line 160, which in turn is connected to a line 170 via the extraction column heat exchanger 145 that also connects lines 140 and 150 as described above. Thus line 160 is connected to a second inlet 161 of the extraction column heat exchanger 145, which is internally connected to a second outlet 169 that discharges into line 170. Preferably, the extraction column heat exchanger 145 may be installed in a counter current operating mode. In particular, the second outlet 169 may be located on the same side of the extraction column heat exchanger 145 as the first inlet 141 while the second inlet 161 may be located on the same side of the extraction column heat exchanger 145 as the first outlet 149. Line 170 is connected to the first inlet 171 of the further heat exchanger 175, and discharges into the first cooling tube bundle.

Thus, the extraction column heat exchanger 145 is provided in the first connecting means 155 and the second connecting means 165 for indirect heat exchanging between the pre-cooled hydrocarbon stream 140 and the effluent 160 from the vapour outlet 159 of the extraction column 125.

Additionally, the further heat exchanger 175 is provided with a first shell inlet 421 and a second shell inlet 441 both to provide access to the cooling zone in the further heat exchanger 175, and a shell outlet 389 to discharge spent cooling refrigerant from the cooling zone.

The pressure of the effluent stream 160 discharged from the extraction column through vapour outlet 159 may be anywhere in the range of from about 25 bara to about 80 bara. If the ultimate goal is to produce a liquefied hydrocarbon stream, the a higher pressure in this range is preferred. During subsequent liquefaction the pressure is preferably between 40 bara and 100 bara, more preferably above 60 bara.

In one group of embodiments, the pressure of the effluent stream 160 is not deliberately changed after discharge from the vapour outlet 159 and before and during liquefaction. De minimis pressure reduction as a result of passing the effluent stream 160 through conduits, junctions and heat exchangers is not considered to be a deliberate pressure change. In such embodiments, the pressure of the cooled methane-enriched hydrocarbon stream 180 is typically between 5 and about 15 bar lower than the pressure of the vapour effluent 160 as it is discharged from the vapour outlet 159.

In another group of embodiments, the pressure of the effluent stream 160 is increased after discharge from the vapour outlet 159 and preferably before liquefaction, for instance using a booster compressor (not shown), optionally in combination with a turbo-compressor coupled to a turbo-expander, arranged in line 170 between the extraction column heat exchanger 145 and the further heat exchanger 175.

The refrigerant circuit 300 comprises refrigerant circulation means arranged to supply the cooling refrigerant (420, 440) to the cooling zone in the further heat exchanger 175 and to withdraw spent cooling refrigerant 390 from the further heat exchanger 175 downstream of the cooling zone in the further heat exchanger 175. The refrigerant circuit 300 may comprise a main refrigerant compressor (not shown), optionally preceded by a suction drum (not shown), but followed by one or more coolers (not shown) wherein the compressed main refrigerant may be cooled against ambient, and an optional accumulator (not shown). This equipment provides a compressed ambient cooled main refrigerant stream in line 310, which is connected to the third inlet 311 in the pre-cooling heat exchanger 135. The third outlet 319 is connected to the first and second inlets 331,381 of the further heat exchanger 175 via lines 320, 330 and 380, which are connected to each other via a main refrigerant gas/liquid separator 325. The main refrigerant gas/liquid separator 325 has an inlet 321 into which line 320 discharges, a vapour effluent outlet 329 discharging into line 330, and a liquid effluent outlet 339 discharging into line 340.

However, the main refrigerant gas/liquid separator 325 is optional—in other embodiments the third outlet 319 in the pre-cooling heat exchanger 135 may be connected to a single second inlet into the further heat exchanger 175. In such other embodiments, the further handling of the main refrigerant through the further heat exchanger 175 may be much like what has been described above for the pre-cooling refrigerant in the pre-cooling heat exchanger 135.

Nevertheless, in the embodiment as shown in FIG. 1, the first second outlet 409 is connected to the first shell inlet 421 via lines 410 and 420 which are connected to each other via a first expansion device that is here shown in the form of a Joule-Thomson valve 415. The second outlet 429 is connected to the second shell inlet 441 via lines 430 and 440, which are connected to each other via at least a second expansion device that is here shown in the form of a Joule-Thomson valve 435. Optionally, the Joule-Thomson valve is preceded by an expander in the form of a (small) turbine (not shown). The shell outlet 389 discharges into line 390, which serves to convey spent main cooling refrigerant back to the main refrigerant compressor (optionally via a suction drum) where it can be recompressed to provide the compressed ambient cooled main refrigerant stream in line 310. This completes the main cooling refrigerant circuit 300.

Preferably, there is no additional deliberate heat exchanger present between third outlet 319 in the pre-cooling heat exchanger 135 and any one of the first and second inlets 331,381 of the further heat exchanger 175. Thus, preferably no heat exchanging with another medium will be taking place other than de-minimis unavoidable heat exchanging with the environment via the piping used via lines 320, 330 and 380, and via the optional main refrigerant gas/liquid separator 325. The temperature of the wet hydrocarbon stream as it passes into the further heat exchanger 175 is therefore preferably essentially equal to the temperature of the pre-cooled main refrigerant stream 320 as it is discharged from the pre-cooling heat exchanger 135 via the third outlet 319. In practice this may mean that the temperature of pre-cooled main refrigerant stream 320 as it passes into the further heat exchanger 175 is less than 5° C. different, preferably less than 2° C. different, from the temperature of the pre-cooled main refrigerant stream 320 as it is discharged from the pre-cooling heat exchanger 135 via the third outlet 319.

Optionally, not the full effluent from the third outlet 319 in the pre-cooling heat exchanger 135 is passed to the further heat exchanger 175, but only continuing parts of the effluent. In the embodiment shown in FIG. 1, the vapour effluent stream 330 from the optional main refrigerant gas/liquid separator 325 and part 380 of the liquid effluent stream 340 from the optional main refrigerant gas/liquid separator 325 represent such continuing parts. An optional main refrigerant splitting device 345 is provided in line 340 to split the liquid effluent stream 340 into a continuing second part liquid pre-cooled main refrigerant stream 380 and a third part pre-cooled main refrigerant stream 350. This third part pre-cooled main refrigerant stream 350 may provide cooling duty elsewhere than the further heat exchanger 175 as will be explained later herein.

In operation, the method and apparatus as covered by the process flow scheme of FIG. 1 may work as follows. At least a part 130 of the hydrocarbon stream 110, and the main refrigerant stream 310, are pre-cooled in the pre-cooling heat exchanger 135 by indirect heat exchanging against the pre-cooling refrigerant that has been allowed access into the pre-cooling cooling zone of the pre-cooling heat exchanger 135 from line 230 via the shell inlet 231. The pre-cooling refrigerant is evaporating with heat that is extracted from the at least part 130 of the hydrocarbon stream 110, the main refrigerant stream 310 and the compressed ambient cooled pre-cooling refrigerant stream 210 flowing through the pre-cooling tube bundles. As a result, the pre-cooling heat exchanger 135 provides the pre-cooled hydrocarbon stream 140 and the pre-cooled main refrigerant stream 320 each having substantially the same pre-cooling temperature.

The pre-cooled hydrocarbon stream 140 is passed to the first inlet 151 of the extraction column 125. The pre-cooled hydrocarbon stream 140 is typically in a partially condensed phase. An effluent stream, in the form of a vaporous methane-enriched hydrocarbon stream 160, and a liquid methane-depleted hydrocarbon stream 190 are discharged from the extraction column 125. In the case of a hydrocarbon feed stream 110 consisting of natural gas, the methane-depleted hydrocarbon stream 190 typically contains natural gas liquids (NGL) comprising ethane, propane, and butane. $C_5$+ components may also be present. The methane-depleted hydrocarbon stream 190 is typically fed to a fractionation train to recover individual components, which will not be further explained herein.

The pre-cooled hydrocarbon stream 140 is passed from the first inlet 141 into the extraction column heat exchanger 145, through the extraction column heat exchanger 145 in indirect heat exchanging interaction with the effluent stream 160, to the first outlet 149 from the extraction column heat exchanger 145. The effluent stream 160 is passed from a second inlet 161 into the extraction column heat exchanger 145, through the extraction column heat exchanger 145 in indirect heat exchanging interaction with the pre-cooled hydrocarbon stream 140, to the second outlet 169 from the extraction column heat exchanger 145. Preferably, the effluent stream 160 is passed through the extraction column heat exchanger 145 in counter current relative to the pre-cooled hydrocarbon stream 140.

Heat may be added to the extraction column 125 to generate an upward vapour flux through the contacting zone. For instance, a heat source may be arranged to add heat to the extraction column 125 at a location that is gravitationally lower than the first inlet 151, preferably at a location below the contacting zone 126. More will be disclosed about that later herein.

Optionally, cooling capacity is provided to a high region in the extraction column, such as above the contacting zone, to create a downward liquid flux through the contacting zone. This may for instance be done using an auxiliary heat exchanging arrangement extracting heat from one or more of the following by heat exchanging at least one of the following against an auxiliary refrigerant stream 360:

- the pre-cooled hydrocarbon stream 140 between the first inlet 141 into the extraction column heat exchanger 145 and the first inlet 151 of the extraction column 125;
- the effluent stream 160 between the vapour outlet 159 from the extraction column 125 and the second outlet 169 from the extraction column heat exchanger 145;
- vapour and/or liquid within the extraction column 125 in an area being gravitationally minimally as high as the first inlet 151 into the extraction column 125 and maximally as high as the vapour outlet 159 from the extraction column 125.

For instance, as a result of adding and/or extracting heat from the extraction column, the vapour effluent from the extraction column that is withdrawn from the vapour outlet 159, typically a methane-enriched hydrocarbon stream 160, generally may have a temperature that is different from the temperature of the pre-cooled main refrigerant stream 320.

In order to bring the temperature of the methane-enriched hydrocarbon stream 160 closer to the temperature of the pre-cooled main refrigerant stream 320 before feeding at least parts of both streams to the further heat exchanger 175, the methane-enriched hydrocarbon stream 160 is indirectly heat exchanged against the pre-cooled hydrocarbon stream 140. The effect is that the temperature in the extraction column 125 is more or less "decoupled" or "isolated" from the temperature in the pre-cooled hydrocarbon stream 140 and the methane-enriched hydrocarbon stream 170 discharged on the other side of the extraction column heat exchanger 145.

The adding and extraction of heat as described above can help to achieve the correct temperature profile in the extraction column 125 in a stationary state of operation.

The methane-enriched hydrocarbon stream 170 discharged from the extraction column heat exchanger 145 and at least a part of the pre-cooled main refrigerant stream 320 can then be passed to the further heat exchanger 175 with a much smaller temperature difference, e.g. less than 10° C., than would be the case if the methane-enriched hydrocarbon stream 160 would be directly passed from the vapour outlet 159 of the extraction column 125 to the first inlet 171 of the further heat exchanger 175. Depending on the composition of the hydrocarbon stream 110 compared to the desired composition of the methane-enriched hydrocarbon stream 160 and/or on the operation of the extraction column 125 in terms of pressure and temperature profile in the extraction column 125, the methane-enriched hydrocarbon stream 160 may be either cooled or warmed in the extraction column heat exchanger 145.

Thus, preferably the temperature of the methane-enriched hydrocarbon stream 170 as admitted into the further heat exchanger 175 via the first inlet 171 is within less than 10° C. different from the temperature of the at least part of the pre-cooled main refrigerant stream 320 as it is admitted into the further heat exchanger 175 (e.g. via least one of the second inlets 331 and 381).

While it is possible to install a further heat exchanger in the methane-enriched hydrocarbon stream 170 between the extraction column heat exchanger 145 and the further heat exchanger 175 in order to even better match the temperatures between the methane-enriched hydrocarbon stream 170 and the pre-cooled main refrigerant stream 320 as it is admitted into the further heat exchanger 175 as they are admitted to the further heat exchanger 175, for reasons of capital expenditure control and operational simplicity it is preferred that the temperature of the methane-enriched hydrocarbon stream 170 in the first inlet 171 is essentially the same as the temperature of the methane-enriched hydrocarbon stream 170 that was reached by the indirectly heat exchanging against the pre-cooled hydrocarbon stream 140 in the extraction column heat exchanger 145. To this end, line 170 is preferably essentially free from any separate heat exchanger between the extraction column heat exchanger 145 and the first inlet 171 of the further heat exchanger 175. The methane-enriched hydrocarbon stream 170 that is discharged from the extraction column heat exchanger 145 is thus preferably not passed through any deliberate heat exchanger, and preferably no heat exchanging with another medium will be taking place other than de-minimis unavoidable heat exchanging with the environment via the piping and optionally other non heat-exchanger equipment used for the connection between the extraction column heat exchanger 145 and the first inlet 171 of the further heat exchanger 175. In practice this may mean that the temperature of the methane-enriched hydrocarbon stream 170 that passes through the first inlet 171 is less than 5° C. different, preferably less than 2° C. different, from the temperature of the methane-enriched hydrocarbon stream 170 as it is discharged from the extraction column heat exchanger 145.

Both the heat exchanged methane-enriched hydrocarbon stream 170, and the at least part of the pre-cooled main refrigerant stream 320, are further cooled in the further heat exchanger 175, thereby providing a cooled methane-enriched hydrocarbon stream 180 and at least one cooled main refrigerant stream 410,430. The cooled methane-enriched hydrocarbon stream 180 may be depressurized in an end-flash system or depressurization stage as known in the art, and subsequently stored in a cryogenic liquid storage tank at a pressure of between 1 and 2 bar absolute. This will not be described in further detail herein.

The pre-cooled main refrigerant stream 320 may be partially condensed and separated in the main gas/liquid separator 325 into a first main refrigerant part stream 330 that is withdrawn via the vapour effluent outlet 329 from the main gas/liquid separator 325 in vapour phase, and a second main refrigerant part stream 340 that is withdrawn via the liquid effluent outlet 339 from the main gas/liquid separator 325 in liquid phase. The first main refrigerant part stream 330 is passed into the further heat exchanger 175 via the first second inlet 331. The second main refrigerant part stream 340 is split, whereby only the continuing second part liquid pre-cooled main refrigerant stream 380 is passed into the further heat exchanger 175 via the second inlet 381.

If the goal is to ultimately liquefy the vapour effluent stream 160, it may be optionally compressed to a pressure of for instance 60 or 70 bar absolute or higher before feeding it to the extraction column heat exchanger 145. For this purpose, an overhead compressor may be provided in line 160 (not shown). By such compression, the amount of latent heat that needs to be extracted from the vapour effluent stream 160 in order to liquefy it will become smaller. Examples are shown and described in e.g. patent application publications US2009/0064712 and US2009/0064713.

As disclosed above, an auxiliary refrigerant stream 360 may be employed to extract heat from a high region in the extraction column 125. This can be done using direct heat exchanging, e.g. by injecting into the extraction column the auxiliary refrigerant stream in the form of a relatively cold wash liquid having a temperature that is lower than the temperature in the top of the extraction column. Or it can be done using indirect heat exchanging, whereby the auxiliary refrigerant stream is kept separate from (not co-mingled with) the liquids and vapours in the extraction column 125 that are in fluid communication with the vapour outlet 159 and the first inlet 151.

The latter option is particularly useful, but not exclusively so, in embodiments wherein the auxiliary refrigerant stream is cycled in a refrigerant circuit. This could be a dedicated refrigerant circuit in which case the auxiliary refrigerant can be of any suitable composition. However, preferably the auxiliary refrigerant 360 comprises at least a part of the pre-cooled main refrigerant stream 320. This way less additional equipment is necessary, because compressors and such are already provided in the main refrigerant circuit.

In one example, the pre-cooled main refrigerant stream 320 is separated into a vaporous light fraction main refrigerant stream 330 and a liquid second part pre-cooled main refrigerant stream 340 in the main refrigerant gas/liquid separator 325. The liquid second part pre-cooled main refrigerant stream 340 is then split into a continuing second part pre-cooled main refrigerant stream 380 and a third part pre-cooled main refrigerant stream 350 using the optional main refrigerant splitting device 345.

The auxiliary refrigerant stream may then be obtained from the third part pre-cooled main refrigerant stream 350. Suitably, the third part pre-cooled main refrigerant stream 350 is expanded in an optional expansion means, shown in FIG. 1 as a Joule Thompson valve 355, thereby forming an expanded third part pre-cooled refrigerant stream 360 such that the methane-enriched hydrocarbon stream 160 is heat exchanged against the expanded third part pre-cooled refrigerant stream 360.

After its heat exchanging, the expanded third part pre-cooled refrigerant stream 360 is discharged from the indirect heat exchanging in the form of a spent third part pre-cooled refrigerant stream 370, and routed back to a suction of the main refrigerant compressor (not shown) of refrigerant circuit 300.

In the embodiment shown in FIG. 1, the additional heat exchanging with the stream derived from the third part pre-cooled main refrigerant stream 350 is performed in the extraction column heat exchanger 145 by passing it through the extraction column heat exchanger 145 from an auxiliary inlet 361 to an auxiliary outlet 369. If the extraction column heat exchanger 145 is provided in the form of plate-type heat exchanger, the auxiliary inlet 361 and the auxiliary outlet 369 may communicate with an additional set of channels or chambers of the extraction column heat exchanger 145. Alternatively, a separate auxiliary heat exchanger (not shown) may be provided in line 160 and/or line 150, arranged to perform the additional indirect heat exchanging with the stream derived from the third part pre-cooled main refrigerant stream 350.

Irrespective of how and/or whether any optional additional heat exchanging is employed, the extraction column 125 may be operated in a number of ways.

In the embodiments, such as illustrated by FIG. 1, the extraction column 125 is provided in the form of a scrub column. A feed splitter 115 may be provided in the feed line 110 upstream of the extraction column 125 and the pre-cooling heat exchanger 135. This allows splitting of the hydrocarbon stream 110 into a first part hydrocarbon stream 130, which forms the at least part of the hydrocarbon stream 110 that is subjected to said cooling by indirect heat exchanging against said pre-cooling refrigerant 230 in the pre-cooling heat exchanger 135, and a second part hydrocarbon stream 120. The first part hydrocarbon stream 130 and the second part hydrocarbon stream 120 have mutually the same composition.

The extraction column 125 is operated at a pressure that is substantially equal to the feed pressure of the hydrocarbon stream 110, minus the pressure loss caused by said indirect heat exchanging of said first part hydrocarbon stream 130 of the hydrocarbon stream 110 against said pre-cooling refrigerant 230 and the pressure loss caused by said indirect heat exchanging of the pre-cooled hydrocarbon stream 140 against the methane-enriched hydrocarbon stream 160. Thus, the pressure in the extraction column 125 may be substantially equal to the feed pressure minus the pressure loss caused by said indirect heat exchanging of said first part hydrocarbon stream 130 of the hydrocarbon stream 110 against said pre-cooling refrigerant 230 and the pressure loss caused by said indirect heat exchanging of the pre-cooled hydrocarbon stream 140 against the methane-enriched hydrocarbon stream 160. No dedicated pressure-lowering device is present in the lines connecting the feed splitter 115 with the first inlet 151 of the extraction column 125 via the pre-cooling heat exchanger 135 and the extraction column heat exchanger 145.

This has the advantage that the amount of recompression in the vapour effluent stream from the extraction column prior to feeding into the further heat exchanger 175 can be kept to a minimum, or even recompression can be dispensed with, while still enjoying a pressure that has not been deliberately lowered solely for the benefit of the distillation or separation process in the extraction column 125. Thus, the distillation is performed without significantly decreasing the pressure, which will be energetically beneficial in case that the vaporous effluent stream 160 is to be liquefied. The pressure loss in each of the pre-cooling heat exchanger 135 and the extraction column heat exchanger 145 may be typically between 1 and 5 bar per heat exchanger such that the total pressure loss is between approximately 2 and 10 bar.

The second part hydrocarbon stream 120 is passed to a second inlet 121 of the extraction column 125. The second inlet 121 is gravitationally lower than the first inlet 151 of the extraction column 125. The pre-cooling heat exchanger 135 is bypassed, thus the second part hydrocarbon stream 120 does not pass through the pre-cooling heat exchanger 135 between the feed splitter 115 and the second inlet 121. The splitting ratio is regulated with a first flow-control valve 117 provided in line 120, preferably between the feed splitter 115 and the second inlet 121. The pressure drop over this flow-control valve 117 is kept to what is minimally necessary in order to allow the first part hydrocarbon stream 130 to pass through the pre-cooling heat exchanger 135 and the extraction column heat exchanger 145.

As a consequence, the second part hydrocarbon stream 120 may be passed through the second inlet 121 into the extraction column 125 at a temperature that is essentially equal to the feed temperature or at least close thereto. The temperature difference between the temperature of the second part stream 120 as it is passed through the second inlet 121 of the extraction column 125, and the feed temperature may be less than about 5° C.

The temperature of the second part stream 120 as it is passed through the second inlet 121 of the extraction column 125 is preferably higher than that of the pre-cooled hydrocarbon stream as it is passed through the first inlet 151 of the extraction column 125.

By selecting the split ratio (defined as defined as the mass flow rate of the second part hydrocarbon stream 120 divided by the mass flow rate of the first part hydrocarbon stream 130) in the feed splitter 115 sufficiently high, as regulated using the setting of the flow control valve 117, no additional heating power (other than the sensible heat present in the second part hydrocarbon stream 120) usually needs be added at all to the bottom of the extraction column for the purpose of controlling the bottom temperature.

It has been found that the split ratio can be selected such that the temperature in the bottom of the distillation column can for instance be maintained at −10° C. or higher. The temperature in the bottom end of the distillation column can be controlled by regulating the split ratio. Reference is made to e.g. patent application publication US 2008/0115532, wherein temperature control by controlling feed stream split ratio has been proposed earlier.

The feeding of the second part hydrocarbon stream 120 adds heat to the extraction column 125. If possible, the second part hydrocarbon stream 120 is not additionally heated and no external heating is provided to the bottom of the extraction column 125. An advantage of this is that less additional heating power, normally provided to a distillation process for instance via a reboiler, needs be into the bottom end of the distillation column to avoid it becoming too cold. However, depending on the feed temperature of the hydrocarbon stream 110 compared to the minimum design temperature, optional heating may have to be applied in order to bring the temperature of the second part hydrocarbon stream 120 to above the minimum design temperature. For this reason, an optional external heater may be provided in line 120 (not shown).

The pre-cooling refrigerant and the main refrigerant may be cycled in mutually separate refrigerant circuits, such as described in for instance U.S. Pat. No. 6,370,910, one of these cycles employing one or more pre-cooling refrigerant compressors and the other employing one or more main refrigerant compressors. In such a case, each of the pre-cooling refrigerant and the main refrigerant may be composed of a mixed refrigerant. A mixed refrigerant or a mixed refrigerant stream as referred to herein comprises at least 5 mol % of two different components. More preferably, any mixed refrigerant comprises two or more of the group comprising: methane, ethane, ethylene, propane, propylene, butanes and pentanes. Suitably, the pre-cooling refrigerant has a higher average molecular weight than main refrigerant.

More specifically the pre-cooling refrigerant in the pre-cooling refrigerant circuit may be formed of a mixture of two or more components within the following composition: 0-20 mol % methane, 20-80 mol % ethane and/or ethylene, 20-80 mol % propane and/or propylene, <20 mol % butanes, <10 mol % pentanes; having a total of 100%. The main cooling refrigerant in the main refrigerant circuit may be formed of a mixture of two or more components within the following composition: <10 mol % $N_2$, 30-60 mol % methane, 30-60 mol % ethane and/or ethylene, <20 mol % propane and/or propylene and <10% butanes; having a total of 100%.

Alternatively, the pre-cooling refrigerant and the main refrigerant may drawn from a common refrigerant circuit, employing a common refrigerant compressor train to perform the functions of pre-cooling refrigerant compressor(s) and main cooling refrigerant compressor(s) combined such as is characteristic, for instance, of so-called Single Mixed Refrigerant processes. An example of a single mixed refrigerant process can be found in U.S. Pat. No. 5,832,745. In such a single mixed refrigerant process, the refrigerant being cycled in the refrigerant circuit may be formed of a mixture of two or more components within the following composition: <20 mol % N2, 20-60 mol % methane, 20-60 mol % ethane and/or ethylene, <30 mol % propane and/or propylene, <15% butanes and <5% pentanes; having a total of 100%.

FIGS. 2 and 3 illustrate embodiments of the invention wherein a common refrigerant compressor 500 is used to compress both at least a part of the pre-cooling refrigerant as well as at least a part of the main refrigerant. In these figures, spent pre-cooling refrigerant 240 discharged from the pre-cooling heat exchanger 135 is conveyed back to the common refrigerant compressor (optionally via a suction drum) and allowed into the common refrigerant compressor 500 via an intermediate pressure inlet 501 to be recompressed. Spent main refrigerant 390 discharged from the further heat exchanger 175 may be conveyed back to the common refrigerant compressor (optionally via a suction drum) and allowed into the common refrigerant compressor 500 at a lower pressure than the spent pre-cooling refrigerant 240 via a suction inlet 502, to be recompressed. The common refrigerant compressor 500 is shown to be driven by a suitable driver 505 via a drive shaft 506. Typical suitable drivers include gas turbine, steam turbine, electric motor, duel-fuel diesel engine, and combinations of these.

The discharge outlet 507 of the common refrigerant compressor 500 is connected to a discharge line 510, wherein a compressed mixed refrigerant is passed to a train of one or more coolers 520. The one or more coolers 520 function to de-superheat and partly condense the compressed mixed refrigerant from line 510, preferably by cooling against ambient, for instance by passing an air stream or a water stream through the train of one or more coolers 520. The partly condensed refrigerant stream is passed, via a conduit 530, to a pre-cooling refrigerant gas/liquid separator 525 in which it is separated into a vaporous main refrigerant stream 310*a* and a liquid pre-cooling refrigerant stream 210*a*. Line 210*a* with the liquid pre-cooling refrigerant stream is connected to the second inlet 211 into the pre-cooling heat exchanger 135, and line 310*a* with the vaporous main refrigerant stream is connected to the third inlet 311 into the pre-cooling heat exchanger 135. From that point, the course of the streams can be the same as described above with reference to FIG. 1.

However, FIGS. 2 and 3 illustrate variations to the refrigerant flows of FIG. 1 that are now possible since the main refrigerant and the pre-cool refrigerant are derived from a common refrigerant source—here shown in the form of compressed mixed refrigerant line 510. A portion of the pre-cooled main refrigerant 320 may now optionally be cycled back into the pre-cooling heat exchanger 135 to complement the pre-cooling refrigerant.

As an example, FIG. 2 shows an optional second splitter 315 provided in line 350, connecting via line 352 with an optional combiner 357 provided in line 230. Herewith a portion 352 of the third part pre-cooled main refrigerant stream 350 can be added to the pre-cooling refrigerant 230. A recycle-control valve 353 may be provided in line 352 to control the flow of the portion 352 of the third part pre-cooled main refrigerant stream 350 that is allowed into the pre-cooling refrigerant 230.

FIG. 3 shows another example, employing a pre-cooling heat exchanger 135*a* provided with cold tube bundles 136 arranged in the shell gravitationally higher than the shell inlet 231, and warm tube bundles 137 arranged in the shell gravitationally lower than the shell inlet 231. The pre-cooling cooling zone is divided into a warm pre-cooling cooling zone and a cold pre-cooling cooling zone, whereby the cold tube bundles pass though the cold pre-cooling cooling zone and the warm tube bundles pass through the warm pre-cooling cooling zone. The first inlet 131 of the pre-cooling heat exchanger 135*a* is connected with the first outlet 139 through both the warm pre-cooling cooling zone and the cold pre-cooling cooling zone, and the same is the case in respect of third inlet 311 and third outlet 319 of the pre-cooling heat exchanger 135*a*. The second inlet 211 is connected with the second outlet 219 through the warm pre-cooling cooling zone and does not pass through the cold pre-cooling cooling zone.

In the case of FIG. 3, the optional second splitter 315 provided in line 350 connects with a third shell inlet 356 into the pre-cooling heat exchanger 135*a*. The portion 352 of the third part pre-cooled main refrigerant stream 350 that is allowed to pass through line 325 is thus added to the pre-cooling refrigerant within the shell of the pre-cooling heat exchanger 135*a*. A recycle-control valve 353 may be provided in line 352 to control the flow of the portion 352 of the third part pre-cooled main refrigerant stream 350 that is allowed into the pre-cooling heat exchanger 135*a*. The third shell inlet 356 is located gravitationally higher than the cold pre-cooling cooling zone.

FIG. 3 illustrates another variation over the embodiments of FIGS. 1 and 2, wherein the extraction column 125*a* is provided with a third inlet 123 in addition to the respective first and second inlets 151, 121. The third inlet is arranged to receive a third part hydrocarbon stream 122, which is fed from the first part hydrocarbon stream 130. The first part hydrocarbon stream 130 and the third part hydrocarbon stream 122 have mutually the same composition. The flow rate of the third part hydrocarbon stream 122 is regulated with a second flow-control valve 127 provided in line 122.

The temperature of the third part hydrocarbon stream 122 as it is passed through the third inlet 123 into the extraction column 125*a* is preferably between the temperature of the second part hydrocarbon stream 120 as it is passed through the second inlet 121 into the extraction column 125*a* and the temperature of the pre-cooled hydrocarbon stream as it is passed into the extraction column 125*a* via the first inlet 151. One way of achieving this condition is shown in the example of FIG. 3. The third part hydrocarbon stream 122 is tapped from the first part hydrocarbon stream 130 in the pre-cooling heat exchanger 135*a* between the warm pre-cooling cooling zone and the cold pre-cooling cooling zone.

Other arrangements are nevertheless possible depending on the composition of the feed stream 110 and the desired composition of the vapour effluent stream 160 from the extraction column 125*a*. For instance, in embodiments wherein the second part hydrocarbon stream 120 is additionally heated to a temperature above the feed stream temperature, the third part hydrocarbon stream may optionally be tapped off from the first part hydrocarbon stream 130 upstream of the pre-cooling heat exchanger 135 or 135*a*. In such a case, the third part hydrocarbon stream 122 may be passed through the third inlet 123 into the extraction column 125*a* at a temperature that is essentially equal to the feed temperature or at least close thereto. The temperature difference between the temperature of the third part stream 122 as it is passed through the third inlet 123 of the extraction column 125*a*, and the feed temperature may be less than about 5° C. in such a case.

The liquid-vapour contacting zone 126 of the extraction column may be divided into an upper contacting zone 126*a* and a lower contacting zone 126*b* arranged gravitationally lower than the upper contacting zone 126*a*. The third inlet 123 may be located gravitationally below the upper contacting zone 126*a* but above the lower contacting zone 126*b*.

The vapour effluent 160 in the embodiment of FIG. 3 is processed in the same way as described above with reference to FIG. 1.

A mixed refrigerant or a mixed refrigerant stream as referred to herein comprises at least 5 mol % of two different components. More preferably, the mixed refrigerant comprises two or more of the group comprising: methane, ethane, ethylene, propane, propylene, butanes and pentanes.

The person skilled in the art will understand that the present invention can be carried out in many various ways without departing from the scope of the appended claims.

What is claimed is:

1. Method of treating a hydrocarbon stream comprising methane, the method comprising:

cooling at least a part of the hydrocarbon stream and a main refrigerant stream by indirect heat exchanging against a pre-cooling refrigerant, to provide a pre-cooled hydrocarbon stream and a pre-cooled main refrigerant stream;

passing the pre-cooled hydrocarbon stream to a first inlet of an extraction column;

discharging an effluent stream, in the form of a methane-enriched hydrocarbon stream, from the extraction column via a vapour outlet arranged gravitationally higher relative to the first inlet into the extraction column, and a liquid methane-depleted hydrocarbon stream from the extraction column via a liquid outlet arranged gravitationally lower relative to the first inlet into the extraction column;

passing the effluent stream to a further heat exchanger;

passing at least a part of the pre-cooled main refrigerant stream to the further heat exchanger; and cooling both the effluent stream and the at least part of the pre-cooled main refrigerant stream in the further heat exchanger thereby providing a cooled methane-enriched hydrocarbon stream and at least one cooled main refrigerant stream;

wherein said passing of the effluent stream to the further heat exchanger and said passing of the pre-cooled hydrocarbon stream to the first inlet of the extraction column comprises indirectly heat exchanging the effluent stream against the pre-cooled hydrocarbon stream, wherein said indirectly heat exchanging of the effluent stream against the pre-cooled hydrocarbon stream comprises passing the pre-cooled hydrocarbon stream from a first inlet into an extraction column heat exchanger, through the extraction column heat exchanger in indirect heat exchanging interaction with the effluent stream, to a first outlet from the extraction column heat exchanger, and passing the effluent stream from a second inlet into the extraction column heat exchanger, through the extraction column heat exchanger in indirect heat exchanging interaction with the pre-cooled hydrocarbon stream, to a second outlet from the extraction column heat exchanger, further comprising extracting heat from at least one of:

the pre-cooled hydrocarbon stream between the first inlet into the extraction column heat exchanger and the first inlet of the extraction column;

the effluent stream between the vapour outlet from the extraction column and the second outlet from the extraction column heat exchanger;

vapour and/or liquid within the extraction column in an area being gravitationally minimally as high as the first inlet into the extraction column and maximally as high as the vapour outlet from the extraction column;

by heat exchanging against an auxiliary refrigerant stream.

2. The method according to claim 1, wherein the auxiliary refrigerant stream comprises at least a part of the pre-cooled main refrigerant stream.

3. The method according to claim 1, wherein said passing of the at least part of the pre-cooled main refrigerant stream to the further heat exchanger comprises separating the pre-cooled main refrigerant stream into a vaporous light fraction main refrigerant stream and a liquid second part pre-cooled main refrigerant stream; the method further comprising:

splitting the liquid second part pre-cooled main refrigerant stream into a continuing second part pre-cooled main refrigerant stream and a third part pre-cooled main refrigerant stream;

expanding the third part pre-cooled refrigerant stream thereby forming the auxiliary refrigerant stream.

4. The method according to claim 1, further comprising adding heat to the extraction column at a location that is gravitationally lower than the first inlet.

5. The method according to claim 4, further comprising splitting of the hydrocarbon stream into a first part hydrocarbon stream, which is subjected to said cooling by indirect heat exchanging against said pre-cooling refrigerant, said cooling being performed in a pre-cooling heat exchanger, and a second part hydrocarbon stream having the same composition and phase as the first part hydrocarbon stream; and wherein said adding of heat to the extraction column comprises passing the second part hydrocarbon stream to a second inlet of the extraction column being gravitationally lower than the first inlet of the extraction column, whereby the pre-cooling heat exchanger is bypassed.

6. The method according to claim 1, further comprising admitting the effluent stream into the further heat exchanger via a first inlet and admitting the at least part of the pre-cooled main refrigerant stream into the further heat exchanger via least one second inlet, wherein the temperature of the effluent stream and the temperature of at least part of the pre-cooled main refrigerant stream in the first and second inlets in the further heat exchanger are less than 10° C. apart from each other.

7. The method according to claim 1, wherein the hydrocarbon stream comprises natural gas, and wherein the cooled methane-enriched hydrocarbon stream is liquefied natural gas.

8. The method according to claim 1, wherein the cooled methane-enriched hydrocarbon stream is depressurized and stored in a cryogenic liquid storage tank at a pressure of between 1 and 2 bar absolute.

* * * * *